United States Patent [19]

Kennedy et al.

[11] Patent Number: 4,596,533

[45] Date of Patent: Jun. 24, 1986

[54] TOY WORK VEHICLE AND TRAILER ASSEMBLY

[75] Inventors: Melvin R. Kennedy, New York, N.Y.; Dietmar Nagel, Chester, N.J.; Abraham A. Arad, Westport, Conn.

[73] Assignee: Buddy L Corporation, New York, N.Y.

[21] Appl. No.: 708,879

[22] Filed: Mar. 6, 1985

[51] Int. Cl.[4] ..... A63H 17/05

[52] U.S. Cl. ..... 446/434; 73/862.03

[58] Field of Search ..... 446/427, 424, 434, 443, 446/462, 463, 457, 465, 431, 489; 73/862.03

[56] References Cited

U.S. PATENT DOCUMENTS

| | | | |
|---|---|---|---|
| 3,110,176 | 11/1963 | Dreier | 73/862.03 |
| 3,667,291 | 6/1972 | Peak | 73/862.03 |
| 4,304,066 | 12/1981 | Brand et al. | 446/434 |
| 4,389,810 | 6/1983 | Green | 446/434 |
| 4,540,376 | 9/1985 | Turbowitz et al. | 446/443 X |
| 4,540,377 | 9/1985 | Rehkemper et al. | 446/434 X |

*Primary Examiner*—Mickey Yu

*Attorney, Agent, or Firm*—Michael Ebert

[57] ABSTRACT

A toy vehicle having a rear hitching element engageable by a dynamic coupler at one end of a sled-type trailer which may be more or less loaded by a player. The coupler is attached to a spring-biased piston slidable within a box projecting from the trailer whereby the extent to which the piston is withdrawn from the box when the trailer is hauled by the work vehicle depends on the magnitude of the load placed on the trailer. Operatively coupled to the piston is a load-indicating meter whose reading not only tells the player how great a load has been placed on the trailer, but also indicates the ability of the vehicle to haul this load, for the meter pointer will not move beyond the point at which the vehicle is stalled.

10 Claims, 7 Drawing Figures

Fig. 3.
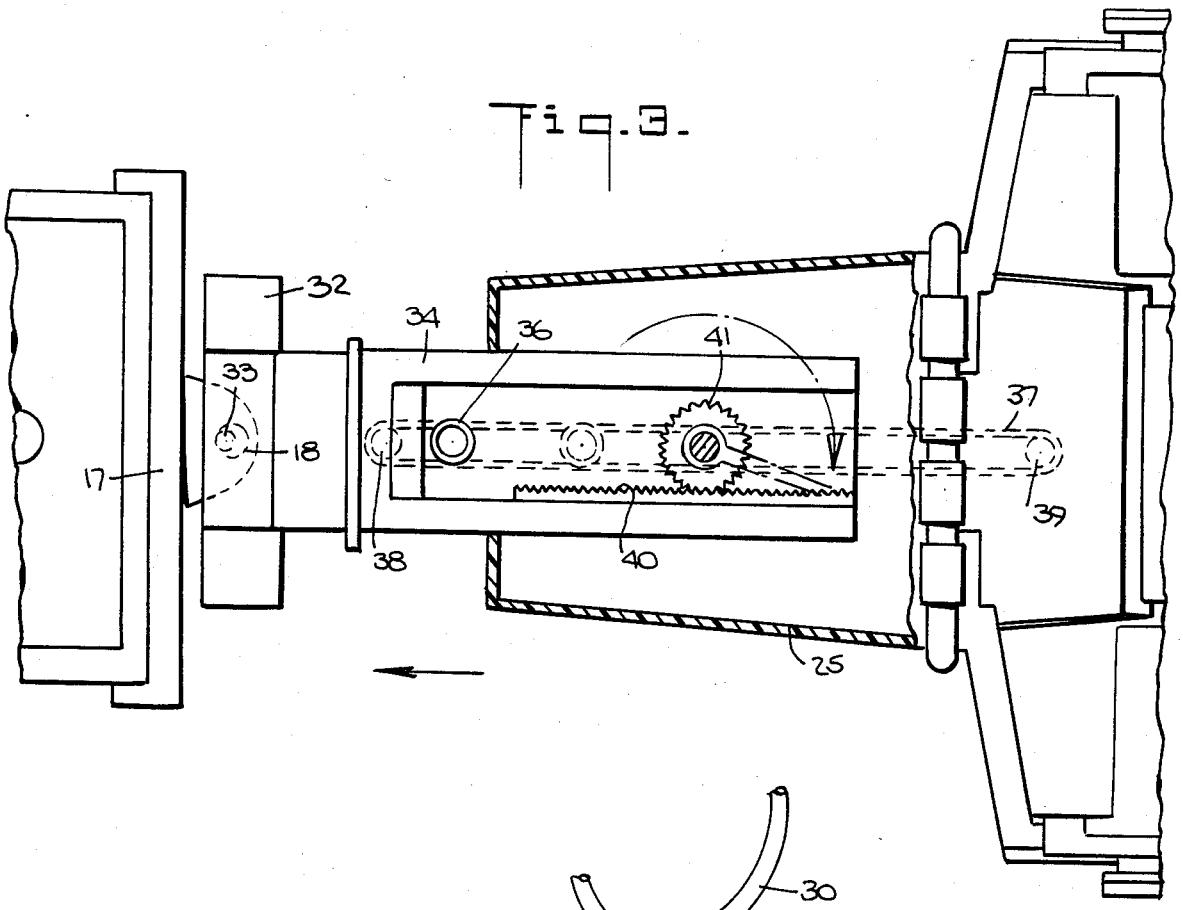
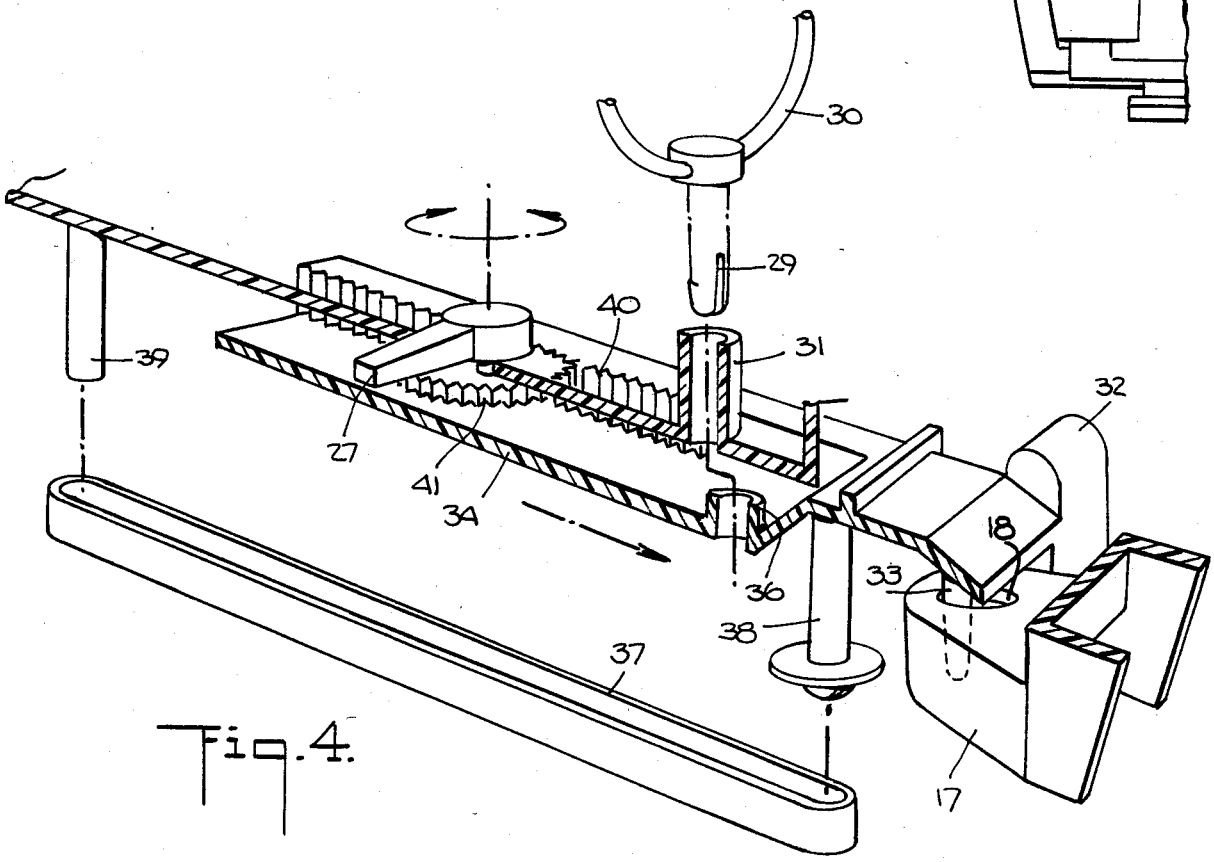
Fig. 4.

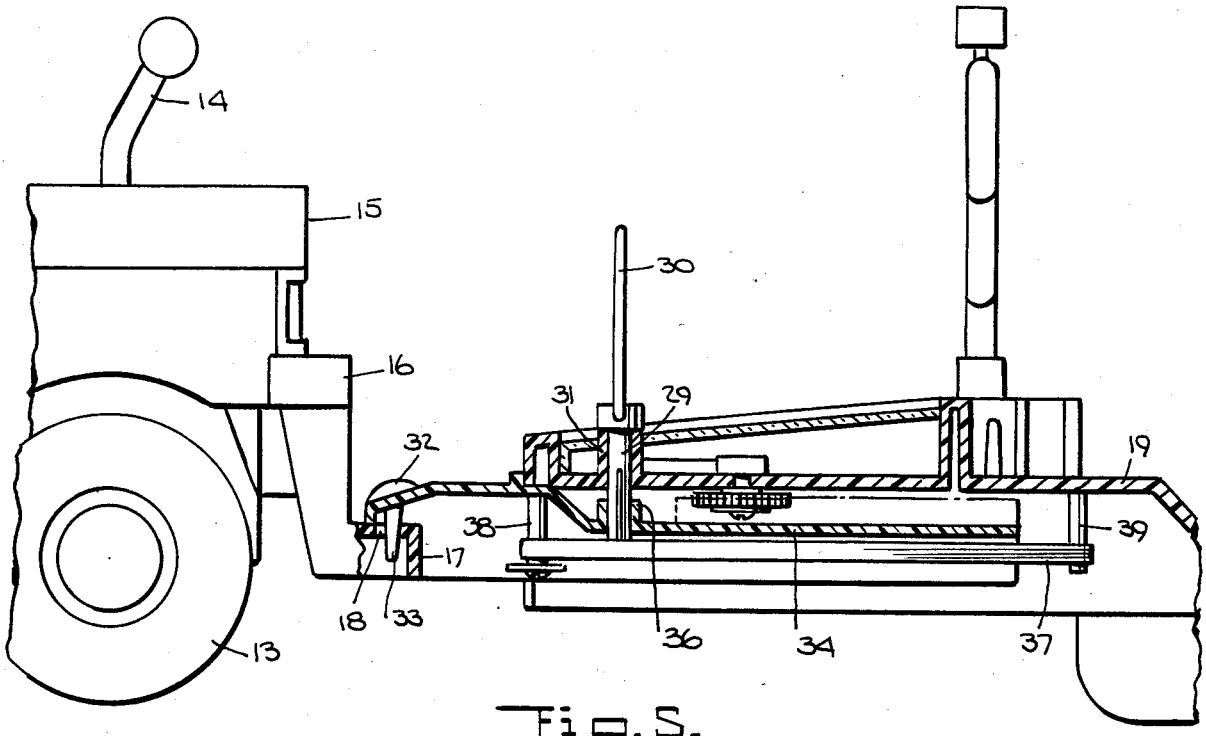
Fig. 5.
Fig. 6.
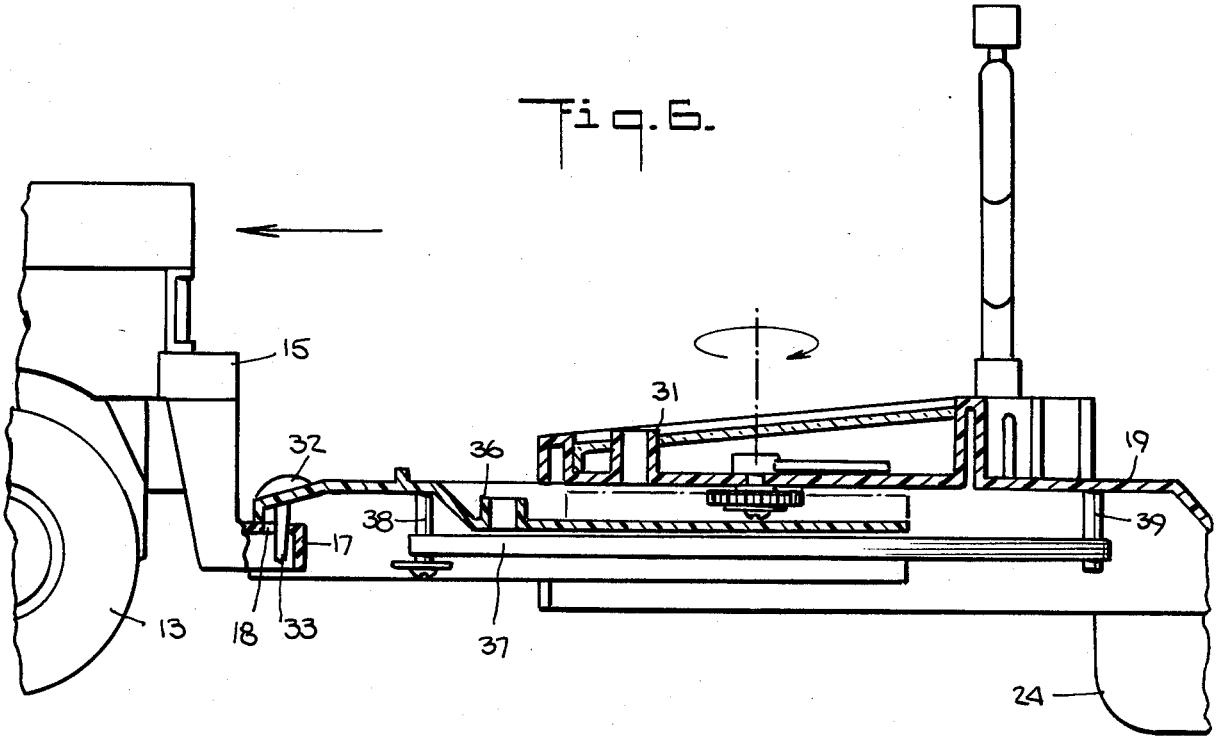

TOY WORK VEHICLE AND TRAILER ASSEMBLY

BACKGROUND OF INVENTION

1. Field of Invention

This invention relates generally to toy work vehicles for tugging a load-carrying trailer, and more particularly to a sled-type trailer adapted to be hitched onto a toy work vehicle and including a load-indicating meter whereby when the trailer is being tugged by a work vehicle, the meter indicates the magnitude of the load.

2. Status of The Art

The most effective toys in terms of play value and sustained interest on the part of the player are those that simulate real-life activity. Thus a toy vehicle is more attractive to a child if it has the appearance of a familiar full-scale, adult vehicle. The toy vehicle is even more appealing if the vehicle performs and can be operated in a manner comparable to the adult version, for then the child can play-act the role of an adult.

Of particular interest to children are work vehicles having a four-wheel drive and provided with tractor-type wheels, making it possible for the vehicle to pull heavy loads, and to travel over rough terrain and therefore reach difficult sites not accessible to ordinary vehicles. In some cases, such work vehicles are provided with a power take-off device such as a winch to wind or unwind a cable having a load-carrying hook at its end, or a crane to hoist loads. In other cases, the vehicle is provided with a rear hitching element, making it possible to couple the vehicle to a load to be hauled. Thus a work vehicle is impressive to a child, for it is not only capable of traveling over rough terrain as well as ordinary paved roads, but it can also exploit its engine to carry out difficult tasks or to pull heavy loads.

Out copending application Ser. No. 651,714, filed Sept. 18, 1984, whose entirely disclosure is incorporated herein by reference, discloses a four-wheel drive toy work vehicle propelled in either direction by a bi-directional d-c motor energized by batteries. In order to emulate the operating controls of a real-life work vehicle having an internal combustion engine and a manual gear shift stick, the toy vehicle is provided with a similar stick which operates a switch connecting the batteries to the d-c motor. In the neutral position of the gear shift stick, the four road wheels of the toy vehicle are disengaged from the d-c motor. In the forward position of the stick, the switch is caused to apply battery power to the motor in a polarity causing forward motion of the toy, and in the reverse position, the polarity of applied power is reversed to cause the vehicle to move in the reverse direction.

In our prior arrangement, the toy work vehicle includes a power take-off device operated by the same d-c motor to turn a wind to wind or unwind a cable hooked to a load or to operate a crane to hoist a load. The concern of the present invention is with a similar work vehicle which does not include a power take-off device but which is provided with a hitching element, making it possible for the vehicle to haul a load-carrying trailer which slides over the ground.

Such sled-type load carriers or trailers are in use on work sites which lack paved roads or where the terrain is not suitable for road wheels. They are pulled by tractors to transport logs and other heavy objects to a pier or other loading terminals for transfer to barges or heavy duty trucks.

SUMMARY OF INVENTION

In view of the foregoing, the main object of this invention is to provide a toy work vehicle and a sled type load-carrying trailer adapted to be hitched thereto to create an assembly in which the vehicle drags the trailer.

More particularly, an object of this invention is to provide a sled-type trailer which includes a dynamic coupler at one end thereof adapted to link the trailer to the hitching element of the toy vehicle, the coupler being linked to the trailer by a spring-biased piston which operates within a box projecting from the trailer, whereby the extent to which the piston is withdrawn from the box when the trailer is hauled depends on the magnitude of the load placed on the trailer by the player.

A significant feature of the invention resides in a load-indicating meter which is operatively coupled to the piston to indicate the magnitude of the load, so that the player is provided with a reading which not only tells him how great a load he has placed on the trailer but is also indicative of the ability of the work vehicle to haul this load. Thus if the load placed on the trailer by the player reaches a point in magnitude where the pulling vehicle is stalled, this point is indicated by the meter. The player, therefore, to test the pulling strength of his toy vehicle, can progressively load the trailer until the stalling point is reached and registered.

Also an object of this invention is to provide a sled-type trailer with couplers at both ends thereof whereby the trailer can be hitched to different vehicles moving in opposite directions in a tug-of-war contest in which the stronger vehicle brings about movement of both the trailer and the other vehicle in the direction taken by the stronger vehicle. Thus an assembly in accordance with the invention has a range of play possibilities and is of sustaining interest to the player.

Briefly stated, these objects are attained in a toy vehicle having a rear hitching element engageable by a dynamic coupler at one end of a sled-type trailer which may be more or less loaded by a player. The coupler is attached to a spring-biased piston slidable within a box projecting from the trailer whereby the extent to which the piston is withdrawn from the box when the trailer is hauled by the work vehicle depends on the magnitude of the load placed on the trailer. Operatively coupled to the piston is a load-indicating meter whose reading not only tells the player how great a load has been placed on the trailer, but also indicates the ability of the vehicle to haul this load, for the meter pointer will not move veyond the point at which the vehicle is stalled.

OUTLINE OF DRAWINGS

For a better understanding of the invention as well as other objects and further features thereof, reference is made to the following detailed description to be read in conjunction with the accompanying drawings, wherein:

FIG. 3 is a longitudinal section taken in the horizontal plane through the box projecting from the trailer;

FIG. 4 is a longitudinal section taken in the vertical plane of the coupler piston;

FIG. 5 is a section taken in the plane indicated by line 5—5 in FIG. 2 in the condition in which the meter box is rendered inoperative by a locking pin;

FIG. 6 is the same as FIG. 5 but with the locking pin removed; and

DESCRIPTION OF INVENTION

Figure 1:
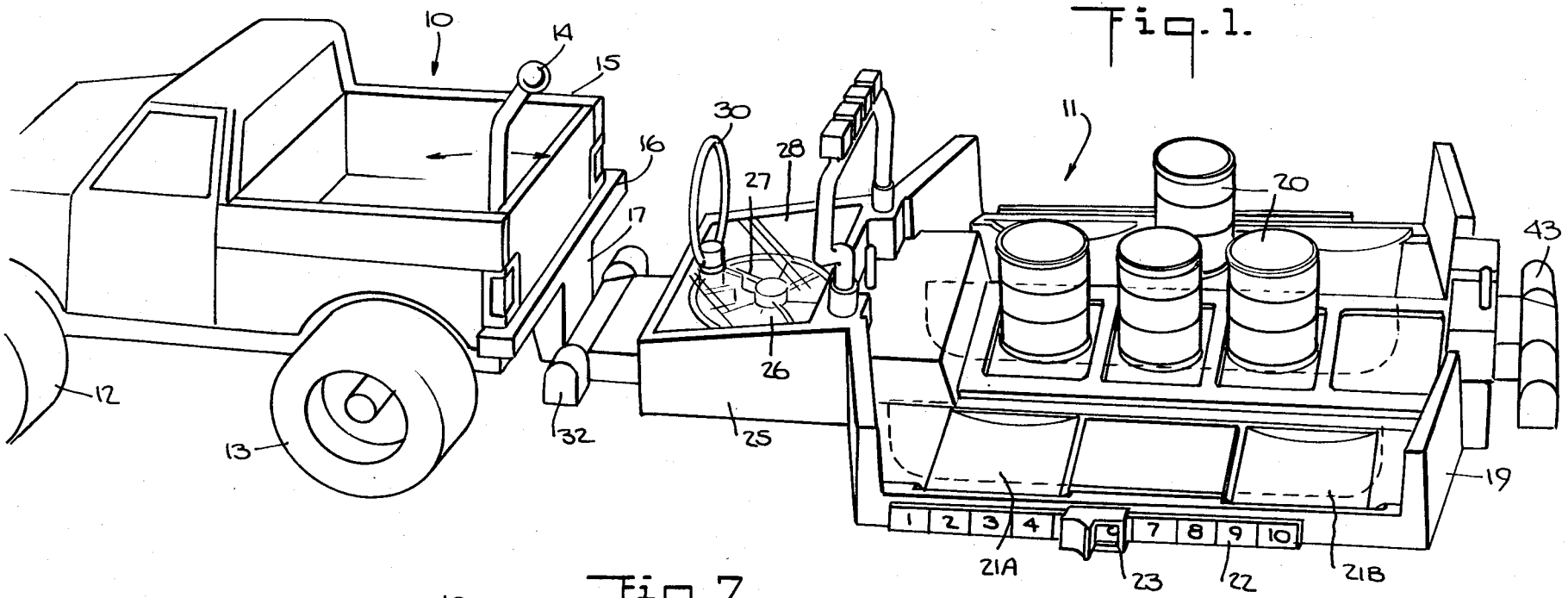
FIG. 1 is a perspective view of a toy work vehicle and load-carrying flat bed trailer assembly in accordance with the invention.
Figure 2:
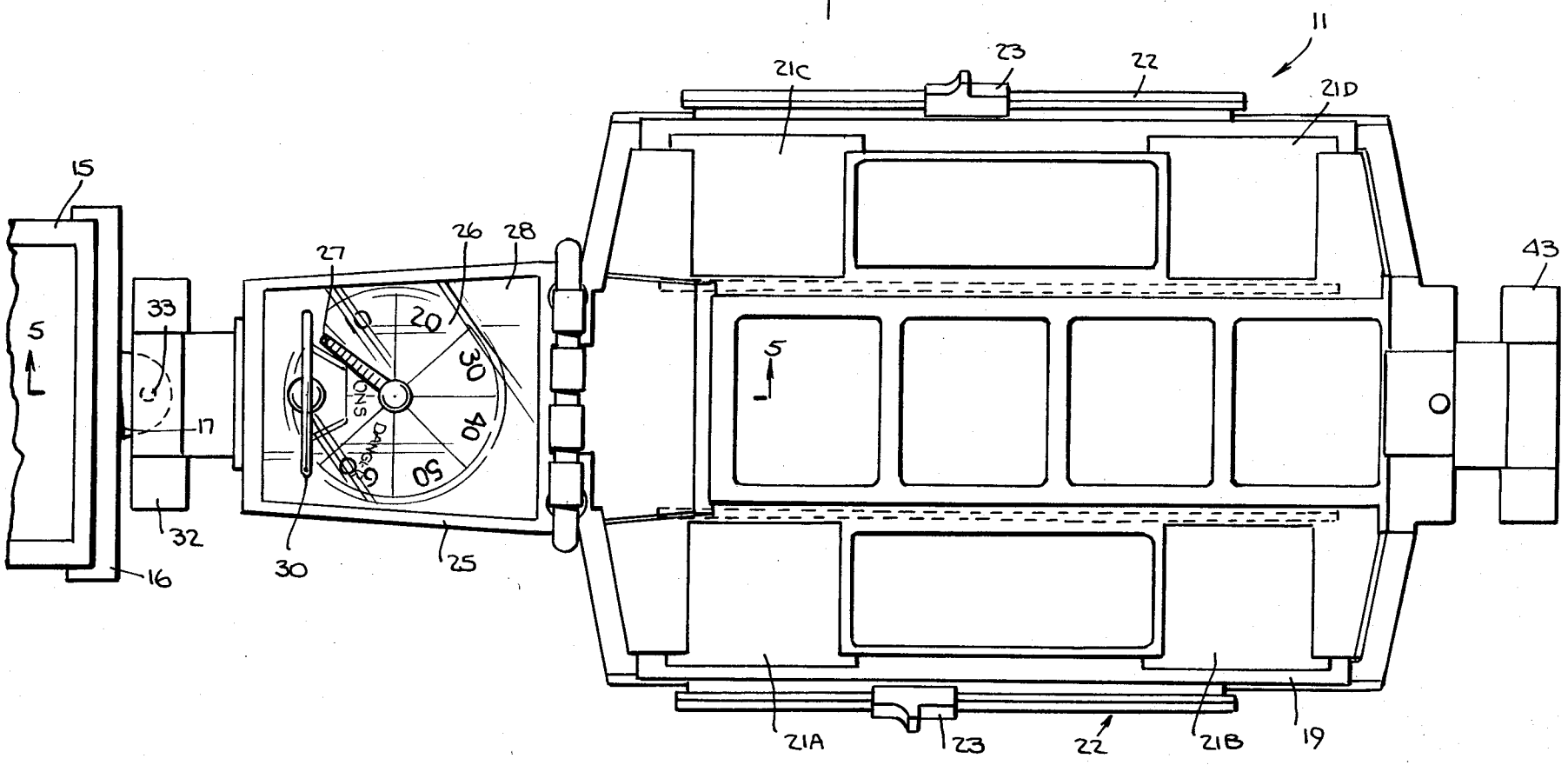
FIG. 2 is a top view of the assembly.

Referring now to FIGS. 1 and 2, there is shown a toy vehicle and a sled-type load-carrying trailer assembly in accordance with the invention, the assembly being constituted by a vehicle generally designated by reference numeral 10, and a trailer by numeral 11.

The toy vehicle may be of any commercially-available type capable of pulling a relatively heavy load. The typical spring-motor toy vehicle is not suitable for this purpose, and it is preferable by far to use a vehicle of the electric motor type powered by batteries. Such vehicles, particular if they include reduction gears, have a relatively large load-carrying capacity. The preferred form of vehicle is generally the type disclosed in our copending patent application, previously identified, in which the vehicle 10, in the form of a pick-up truck, is provided with tractor-type front and rear road wheels 12 and 13 having heavy treads to provide good traction on a play surface or whatever terrain is used.

All four wheels are driven by a miniature battery-powered direct-current motor (not shown) under the control of a manually-operated shift stick 14 located in the open body 15 of the truck. The arrangement is such that when stick 14 is in neutral, the wheels are disengaged from the motor and the toy truck may be propelled by hand.

When stick 14 is advanced to its forward position, a polarity-reversing switch which is actuated by this movement acts to connect the batteries to the motor in a polarity causing the motor to turn in a direction producing forward motion of the vehicle. The polarity is reversed by the switch when the stick is pushed into its rear position to cause the vehicle to move in the reverse direction.

Depending from the rear bumper 16 of the vehicle is a hitching element in the form of an L-shaped bracket 17 whose horizontal ledge has a hole 18 therein to receive a coupling pin (see FIGS. 5 and 6). As pointed out previously, the invention is not limited to a vehicle of the specific type shown; but whatever vehicle is used, it must include a hitching element appropriate to the coupler on the trailer.

Trailer 11, which is preferably molded of plastic material, is formed by a flat bed 19 having shallow depressions therein adapted to receive load elements placed thereon by the player, such as the cylindrical tanks 20 shown in FIG. 1. The trailer may be more or less loaded with whatever items are available to the player, including another toy truck. Thus the trailer bed has four concave corner depressions 21A, 21B, 21C and 21D to nest the wheels of a toy truck similar to track 10.

Along the opposite sides of the trailer bed are linear scales 22. Each scale is graduated from 1 to 10 and is provided with a sliding window 23 so that the player can selectively shift the window to any number on the scale. These two scales are used by two players to keep score when they play a tug-of-war game to be later described.

As best seen in FIGS. 5 and 6 on the underside of the flat bed 19 are a pair of parallel sleds 24 which make it possible to easily slide the trailer on a playing surface. Projecting from the forward end of the trailer bed, as shown in FIGS. 1 and 2, is a meter by 25 within which is a load-indicating (tons) meter having a circular scale 26 divided into radial sectors successively numbered 10, 20, 30, 40, 50 and 60, and a pointer 27 which turns on the scale. The meter is covered by a window 28. Associated with the meter is a locking pin 29 having a loop handle 30, the pin going through a tubular socket 31, as best seen in FIG. 4, where the pin is shown removed from the socket.

Projecting forwardly from meter box 25 is a dynamic coupler 32 provided with a downwardly-extending center prong 33 which goes into hole 18 in the hitching element on the vehicle, thereby coupling the trailer thereto. Coupler 32, as best seen in FIGS. 3 and 4, is attached to the outer end of a piston 34 having a channel-shaped formation. Piston 34 is slidable axially within meter box 25 along a track defined by a pair of guides (not shown).

Piston 34 is provided with a stop hole 36 which registers with the hollow socket 31 in the meter when the piston is in its fully inserted position, as shown in FIG. 5. Thus, when the locking pin 29 is inserted in this socket, it penetrates stop hole 36 to prevent sliding motion of the piston. Only by removing locking pin 29, will the load-indicating meter operate. Hence the player, if he wishes to do so, may cut out the load-indicating meter.

A rubber band 37 functioning as a spring is extended between a post 38 anchored on piston 34 and a post 39 on the trailer bed 19 to spring-bias the piston. Thus when the piston is pulled out, it expands the spring; and when it is released, the spring returns the piston to its fully inserted initial position.

Along one side of piston 34, as shown in FIGS. 3 and 4, a rack 4D is formed which is engaged by a pinion 41 mounted on the shaft of the meter pointer 27. Hence when piston 34 is pulled out of box 25, it causes rotation of the shaft to swing pointer 27 on the meter scale 26 to indicate the extent to which the piston has been withdrawn from the box.

Figure 7:
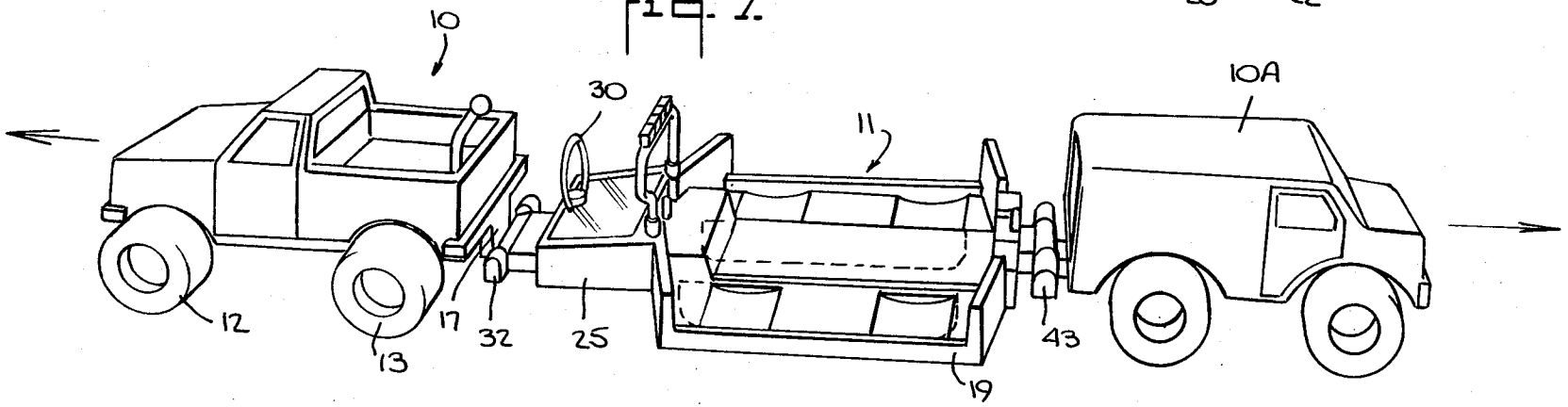
FIG. 7 shows two work vehicles coupled to opposite ends of the trailer to play a tug-of-war game.

The other end of trailer 11 is provided with a static coupler 43 which is fixed to the trailer bed and which may be coupled to the hitching element of another toy work vehicle, such as vehicle 10A, as shown in FIG. 7, or left unhitched.

In playing with the assembly, the player hitches trailer 11 to toy vehicle 10 and then more or less loads the trailer bed 19. He turn by means of stick 10 turns on the motor of the vehicle to cause it to haul the trailer. Because of the load on the trailer and the resistance offered by the road surface to the trailer sled, the dynamic coupler pulls out the spring-biased piston from its box to an extent determined by the magnitude of the load surface by the trailer on the vehicle. This magnitude is indicated by the meter.

If the load is very heavy and has a magnitude beyond the hauling capacity of whatever vehicle is being used, then the pointer will stop at the point at which the vehicle stalls. Thus in playing, the child may continue to increase the load as the vehicle is moving to see to what extent his vehicle is capable of lugging the trailer.

Should the player elect to operate the vehicle in the reverse direction, it will push the trailer in the same direction; but in that case, there will be no load indication, for the trailer works only when the dynamic coupler is pulled, not pushed.

Where two players have their own toy vehicles and the vehicles have means such as reduction gears to provide adjustable hauling powers, one player chan challenge the other to a tug-of-war in which each player couples his vehicle to one end of the trailer, as shown in FIG. 7, and operates his vehicle so that the vehicles pull in opposite directions. In this situation, the meter will indicate the difference in the relative pulling powers of the vehicles. And as in each play one or the other player wins, the winner can score his victory on the side scale 22 on the trailer bed assigned to him.

While there has been shown and described a preferred embodiment of a toy work vehicle and trailer assembly in accordance with the invention, it will be appreciated that many changes and modifications may be made therein without, however, departing from the essential spirit thereof.

We claim:

1. A toy work vehicle and trailer assembly comprising:

A a toy work vehicle having a rear hitching element;

B a load-carrying trailer which may be more or less loaded by a player, the trailer being provided at its front end with a dynamic coupler to engage the hitching element;

C means to indicate the magnitude of the load imposed on the trailer, said means including a spring-biased piston attached to said coupler, said piston being slidable within a box projecting from the trailer and integral therewith, said piston being withdrawn from the box to an extent determined by the magnitude of the load when the work vehicle applies a pulling force to the coupler; and D a stop in to prevent sliding movement of the piston.

2. An assembly as set forth in claim 1, wherein said vehicle includes a d-c battery operated, bi-directional motor coupled to all four wheels of the vehicle to provide a fourwheel drive.

3. An assembly as set forth in claim 2, wherein said motor is coupled to said battery through a polarity-reversing switch operated by a manually operated shift stick.

4. An assembly as set forth in claim 1, wherein said trailer has a flat bed and is provided with sleds.

5. An assembly as set forth in claim 1, wherein said trailer is provided with a static coupler at the other end thereof, whereby the trailer may be hitched to vehicles moving in opposite directions.

6. An assembly as set forth in claim 1, wherein said indicating means includes a meter having a pointer operatively coupled to said piston.

7. An assembly as set forth in claim 6, wherein said piston is provided with a rack engaged by a pinion mounted on the shaft of the pointer.

8. An assembly as set forth in claim 1, wherein said hitching element is an L-shaped bracket having a horizontal ledge provided with a hole which receives a prong projecting downwardly from the coupler.

9. An assembly as set forth in claim 1, wherein said trailer has a flat bed.

10. An assembly as set forth in claim 9, wherein said flat bed has indentations to accommodate the four wheels of a vehicle loaded on the bed.

* * * * *

UNITED STATES PATENT OFFICE

CERTIFICATE OF CORRECTION

Patent No. 4,596,533 Dated June 24, 1986

Inventor(s) Melvin Ray Kennedy et al.

It is certified that error appears in the above-identified patent and that said Letters Patent are hereby corrected as shown below:

Column 6, line 3, change "in" to --pin--

Signed and Sealed this

Seventeenth Day of March, 1987

*Attest:*

DONALD J. QUIGG

*Attesting Officer*

*Commissioner of Patents and Trademarks*